US007339416B2

(12) United States Patent
Rincon-Mora et al.

(10) Patent No.: US 7,339,416 B2
(45) Date of Patent: Mar. 4, 2008

(54) VOLTAGE REGULATOR WITH LOW DROPOUT VOLTAGE

(75) Inventors: Gabriel Alfonso Rincon-Mora, Atlanta, GA (US); Matthias Arnold, Moosburg (DE)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 11/464,587

(22) Filed: Aug. 15, 2006

(65) Prior Publication Data

US 2007/0152742 A1 Jul. 5, 2007

(30) Foreign Application Priority Data

Aug. 18, 2005 (DE) ..... 10 2005 039 114

(51) Int. Cl.
*G05F 1/10* (2006.01)

(52) U.S. Cl. ..... 327/538; 327/541; 327/543

(58) Field of Classification Search ..... 327/538, 327/540, 541, 543, 544, 427, 434; 323/265, 323/268, 277, 280
See application file for complete search history.

(56) References Cited

U.S. PATENT DOCUMENTS 6,046,577 A * 4/2000 Rincon-Mora et al. ..... 323/282
6,373,233 B2 * 4/2002 Bakker et al. ..... 323/282

(Continued)

FOREIGN PATENT DOCUMENTS

EP 1280032 1/2003

(Continued)

*Primary Examiner*—N. Drew Richards
*Assistant Examiner*—Hai L. Nguyen
(74) *Attorney, Agent, or Firm*—William B Kempler; W. James Brady, III; Frederick J. Telecky, Jr.

(57) ABSTRACT

A low dropout voltage regulator (100; 300) comprises a supply input terminal (102; 302) for connecting a supply voltage ($V_{DD}$) and an output terminal (104; 304) for providing a regulated output voltage ($V_0$), a reference voltage source (130; 330); and an output voltage monitor (120; 320). An error amplifier (132; 332) has an output (138; 338) supplying an error signal ($V_{err}$) in response to deviations of the regulated output voltage ($V_{out}$) from a desired target output voltage value ($V_0$) at the output terminal (104; 304). A power output FET (110; 310), has a drain-source channel connected between the supply input terminal (102; 302) and the output terminal (104; 304) of the voltage regulator, and a gate terminal (116; 316). The gate terminal of the power output FET (110; 310) is controlled by the error amplifier (132; 332) via a driver FET (140; 340) in such a way that any deviations of the regulated output voltage (Vout) from a desired target output voltage value ($V_0$) are minimized. The regulator further comprises a bypass FET (150; 350) of an n-conductivity type, which has a source terminal (154; 354) connected to the gate terminal (142; 342) of the driver FET (140; 340), a drain terminal (156; 356) connected to the source terminal (112; 312) of the driver FET (140; 340), and a gate (152; 352) connected to a bias voltage source (158; 358). The bias voltage is determined such that the bypass FET (150; 350) begins conducting when the source voltage of the driver FET (140; 340) cannot be further reduced by application of the error signal ($V_{err}$) to its gate towards the drain potential, due to the inherent gate-source voltage drop ($V_{gs}$) of the driver FET (140; 340).

4 Claims, 4 Drawing Sheets

U.S. PATENT DOCUMENTS 6,414,537 B1 * 7/2002 Smith ..... 327/540
6,465,994 B1 * 10/2002 Xi ..... 323/274
6,501,305 B2 * 12/2002 Rincon-Mora et al. ..... 327/108
6,518,737 B1 * 2/2003 Stanescu et al. ..... 323/280
6,541,946 B1 * 4/2003 Chen et al. ..... 323/280
6,573,694 B2 * 6/2003 Pulkin et al. ..... 323/273
6,703,815 B2 * 3/2004 Biagi ..... 323/280
6,847,260 B2 * 1/2005 Gupta et al. ..... 330/257
2003/0184268 A1 10/2003 Perez et al.
2004/0164789 A1 8/2004 Leung et al.

FOREIGN PATENT DOCUMENTS

EP 1336912 8/2003

* cited by examiner

VOLTAGE REGULATOR WITH LOW DROPOUT VOLTAGE

The invention relates to apparatus and methods for reducing the dropout voltage range in voltage regulator circuits.

BACKGROUND

The demand for voltage regulators having low dropout voltages is increasing because of the growing demand for low voltage applications of mobile electronic devices. For low voltage circuits (for example, rail-to-rail circuits or linear regulators wherein a power-MOS switch must be completely "off" at one extreme and be able to source large amounts of current at the other extreme), a high voltage swing capability is necessary for the output FET (Field-Effect Transistor) to provide an efficient regulation, that is, the output FET has to be driven within less than 500 mV of the positive supply voltage and down to within 500 mV of ground. A typical N-type source-follower, or even an N-type emitter follower, as driver for the output FET has the disadvantage of a high input-to-output voltage drop $V_{gs}$. A P-type follower, on the other hand, is not able to drive the output FET down close to ground. A differential amplifier in unity gain configuration may be able to drive a wider voltage range, but an extra OP-amp (operational amplifier) increases complexity, required footprint area and cost for the circuit. Further, with an OP-amp, an additional pole is introduced in the feedback loop which leads to stability problems, deteriorated speed and bandwidth performance.

SUMMARY

The invention provides a voltage regulator having low voltage dropout, with enhanced performance and stability. A bypass transistor is provided in the output voltage error control loop to extend the normal operating range of the output transistor at low voltages, beyond the previous limitation of the driving transistor gate-to-source voltage.

In described embodiments, a voltage regulator with low dropout voltage comprises a supply input terminal for connecting a supply voltage, an output terminal for providing a regulated output voltage, a reference voltage source, and an output voltage monitor. An error amplifier has a first input connected to the reference voltage source, a second input connected to the output voltage monitor and an output supplying an error signal in response to deviations of the regulated output voltage from a desired target output voltage at the output terminal of the voltage regulator. A power output FET, has a gate terminal and a drain-source channel connected between the supply input terminal and the output terminal of the voltage regulator. The regulator further comprises a driver FET, having a gate terminal connected to the control output of the error amplifier, a drain or source terminal connected to ground and a source or drain terminal connected to the gate of the power output FET. A current source supplies a drain-source current for the driver FET. The gate terminal of the power output FET is controlled by the error amplifier via the driver FET in such a way that any deviations of the regulated output voltage from a desired target output voltage value are minimized. In accordance with an aspect of the invention, a bypass FET has a source or drain terminal connected to the gate terminal of the driver FET, a drain or source terminal connected to the source or drain terminal of the driver FET, and a gate terminal connected to a bias voltage source. The bias voltage source provides a bias voltage set to switch the bypass FET on and bypass the gate-source junction of the driver FET when the gate-to-source voltage of the driver FET becomes a limitation to maintaining normal operation of output voltage regulation.

In one example, the regulator comprises a driver FET of a p-conductivity type, having a gate terminal connected to the control output of the error amplifier, a drain terminal connected to ground and a source terminal connected to the gate of the power output FET. A current source supplies a drain-source current for the driver FET and is connected between the supply input terminal and the source terminal of the driver FET. A bypass FET of an n-conductivity type has a source terminal connected to the gate terminal of the driver FET, a drain terminal connected to the source terminal of the driver FET, and a gate terminal connected to a bias voltage source. The bias voltage source provides a bias voltage which is determined such that the bypass FET begins conducting when the source voltage of the driver FET cannot be further reduced towards the drain potential by application of the error signal to its gate, due to the inherent gate-source voltage drop of the driver FET. The conducting bypass FET bypasses the gate-source junction of the driver FET, allowing the error amplifier to drive the gate of the output FET even further down towards the drain potential. Thus, the driving range for the gate of the output FET is not narrowed by the gate-source voltage of the driver FET.

The invention thus provides a voltage regulator with a low dropout voltage and an extended normal operating range. The output of the regulator can be driven from near ground up to near the supply voltage. The invention combines the high output voltage swing and low output impedance capability of a p-type source-follower with the low output voltage capability of a source-grounded n-type FET. Implementation of the suggested circuit requires only very few components. As a result, the circuit has low power consumption and high error efficiency, while the circuit can be manufactured at low cost.

In an alternative embodiment, a low dropout voltage regulator comprises a supply input terminal for connecting a supply voltage, an output terminal for providing a regulated output voltage, a reference voltage source, and an output voltage monitor. An error amplifier has a first input connected to the reference voltage source, a second input connected to the output voltage monitor and an output supplying an error signal in response to deviations of the regulated output voltage from a desired target output voltage at the output terminal of the voltage regulator. A power output FET, has a gate terminal and a drain-source channel connected between the supply input terminal and the output terminal of the voltage regulator. The regulator further comprises a driver FET of an n-conductivity type, having a gate terminal connected to the control output of the error amplifier, a drain terminal connected to the supply input terminal and a source terminal connected to the gate of the power output FET. A current source supplies a drain-source current for the driver FET and is connected between the source terminal of the driver FET and ground. The gate of the power output FET is controlled by the error amplifier via the driver FET in such a way that any deviations of the regulated output voltage from a desired target output voltage value are minimized. A bypass FET of a p-conductivity type, has a source terminal connected to the gate terminal of the driver FET, a drain terminal connected to the source terminal of the driver FET, and a gate terminal connected to a bias voltage source. The bias voltage source provides a bias voltage which is determined such that the bypass FET begins conducting when the source voltage of the driver FET cannot be further raised towards the drain potential by application of the error signal to its gate, due to the inherent gate-source voltage drop of the driver FET. The conducting bypass FET bypasses the gate-source junction of the driver FET, allowing the error amplifier to drive the gate of the output FET even further up towards the drain potential. Thus, the driving range for the gate of the output FET is not narrowed by the gate-source voltage of the driver FET. So, the low drop voltage regulator according to the invention provides an extended operating range.

BRIEF DESCRIPTION OF THE DRAWINGS

Further advantages and features of the invention will become apparent from the following detailed description with reference to the appended drawings. In the drawings.

DETAILED DESCRIPTION OF EXAMPLE EMBODIMENTS

Figure 1:
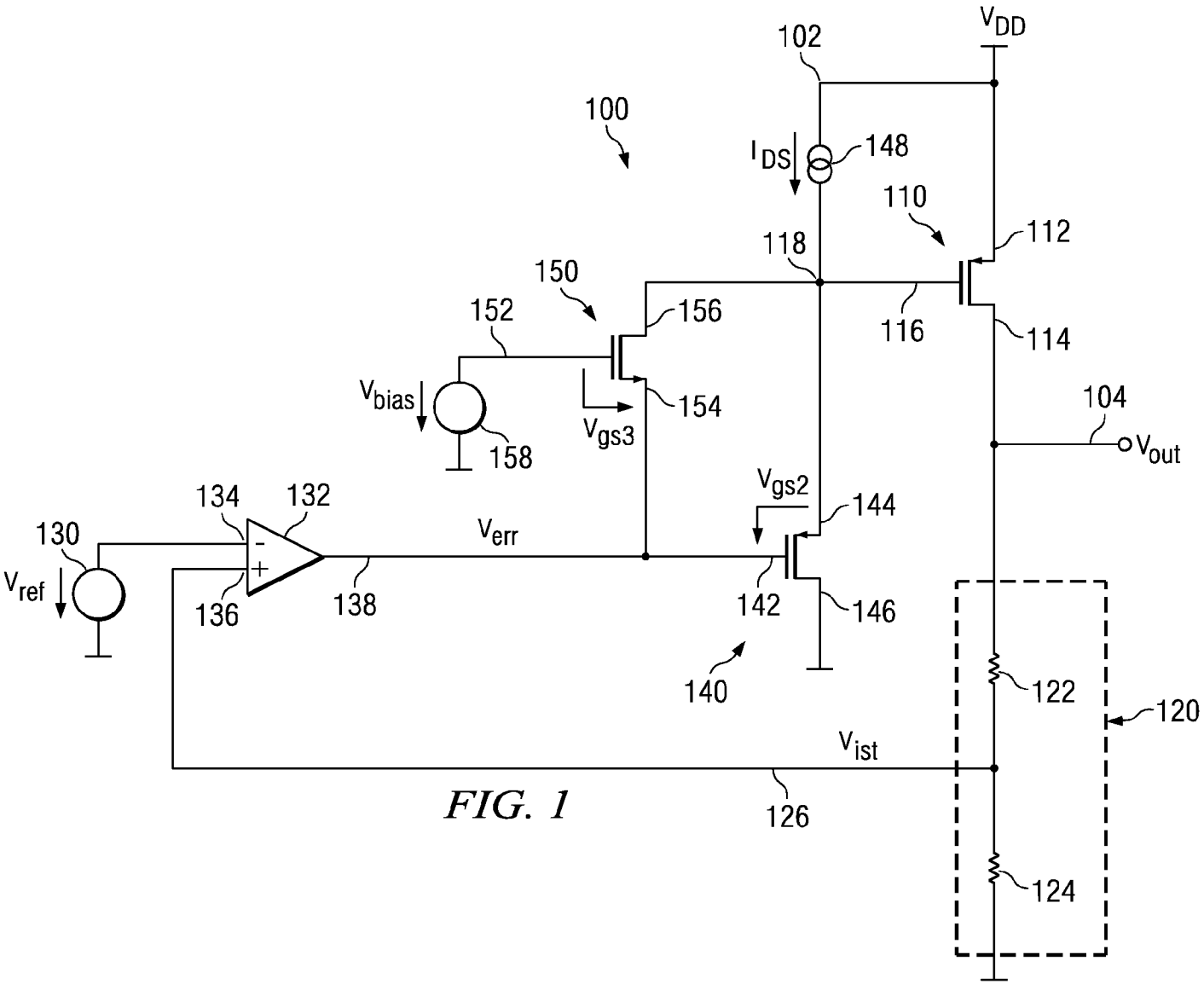
FIG. 1 shows a schematic circuit according to a first embodiment of the invention.

The low dropout voltage regulator 100 illustrated in FIG. 1 has an input terminal 102 for connecting the circuit to a supply voltage $V_{DD}$ and an output terminal 104 to provide an output voltage $V_{out}$. A PMOS output FET 110, has a source terminal 112, a drain terminal 114 and a gate terminal 116. The source terminal 112 is connected to the supply voltage terminal 102, the drain terminal 114 is connected to the output terminal 104 and the gate terminal 116 is connected to a node 118.

A voltage divider comprising resistors 122 and 124, serially connected between the output terminal 104 and ground, constitutes a voltage monitor 120, providing at a tap terminal 126 a monitor voltage $V_{ist}$, proportional to the output voltage $V_{out}$.

A reference voltage source 130 provides a reference voltage $V_{ref}$. An error amplifier 132 has a first input 134 connected to the voltage reference 130, a second input 136 connected to the tap terminal 126 of the voltage monitor 120, and an output 138. The error amplifier 132 compares the actual voltage $V_{ist}$ with the reference voltage $V_{ref}$ and delivers at the output 138 a control voltage $V_{err}$ for controlling the output FET 110.

A PMOS driver FET 140 has a gate terminal 142 connected to the output 138 of the error amplifier 132, a source terminal 144 connected to the node 118 and a drain terminal 146 connected to ground. A current source 148, connected between the input terminal 102 and the source terminal 144 of the driver FET 140 provides a drain-source current $I_{DS}$ for the driver FET 140.

A bypass FET 150, which is an NMOS FET, has a gate terminal 152, a source terminal 154 and a drain terminal 156. The drain terminal 152 is connected to node 118, and the source terminal 154 is connected to the gate terminal 142 of the driver FET 140. A voltage source 158 provides a bias voltage $V_{bias}$ for the gate terminal 152 of the bypass FET 150.

The operation of the voltage regulating circuit 100 is as follows:

The output FET 110 can be controlled via its gate terminal 116 to provide a regulated desired output voltage $V_0$ at the output terminal 104. Deviations of the actual output voltage $V_{out}$, from the desired output voltage $V_0$ due to load current swing caused by a load connected to the output terminal 104 or due to alterations in the supply voltage $V_{DD}$ are monitored by the output voltage monitor 120. The output voltage monitor 120 delivers a monitoring voltage $V_{ist}$ proportional to the actual output voltage $V_{out}$.

A deviation in the output voltage $V_{out}$ causes the error amplifier 132 to adapt the control voltage $V_{err}$ in order to control the output FET 110 via the driver FET 140 in such a way that any deviations of the regulated output voltage $V_{out}$ from the desired target output voltage $V_0$ are minimized. If the actual output voltage $V_{out}$ drops due to an increased load at the output 104, the control voltage $V_{err}$ will be reduced, and the driver FET 140 will drive the gate 116 of the output FET 110 down towards the drain potential. Therefore, the output FET 110 will increase current supply to the output 104 and the actual output voltage $V_{out}$ will rise until the desired output voltage $V_0$ is achieved. Increased demand for current from the supply, of course, causes a drop in the supply voltage $V_{DD}$.

As long as the output FET 110 can be driven by the driver FET 140 to supply enough current to the output to keep the output voltage $V_{out}$ at the desired output voltage level $V_0$, the regulator 100 operates in a regulating load-current range. In this normal operating range, the regulator provides at its output a stable output voltage which is independent of the input voltage.

However, there is a limit for driving the gate 116 of the output FET 110. Due to its inherent gate-source voltage $V_{gs2}$, the driver FET 140 cannot drive the gate 116 of the output FET 110 further towards the potential of the drain terminal than $V_{gs2}$ above ground. At this point, the regulator has reached the end of the regulating load-current range and the potential difference between the supply voltage and the output voltage has reached its minimal value, which is defined as the "dropout" voltage. If the load current increases further or if the supply voltage drops further, the regulator can no longer maintain the desired output voltage level $V_0$. The regulator then enters the dropout range. In this dropout range, any further drop of the supply voltage leads to a drop in the output voltage.

In the proposed circuit, a bypass FET 150 is provided to bypass the gate-source junction of the driver FET 140 when the regulator is about to enter the dropout range. To this end, the bias voltage $V_{bias}$ is determined to define a threshold voltage $V_{tr}=V_{bias}-V_{gs3}$, where $V_{gs3}$ is the gate-source voltage of the bypass FET 150. The bias voltage $V_{bias}$ is determined so that the bypass FET 150 begins conducting when the source voltage of the driver FET 140 cannot be further reduced by application of the error signal $V_{err}$ to its gate towards the drain potential, due to the inherent gate-source voltage drop $V_{gs2}$ of the driver FET 140. So, when the control voltage $V_{err}$ drops below this threshold voltage $V_{tr}$, the bypass FET 150 starts conducting current and the bypass FET 150 gradually bypasses the gate-source junction of the driver FET.

Thus, node 118, which is connected to the gate of the output PMOS FET 110, can be pulled further towards ground. As a result, the dropout voltage of the regulator is reduced and the regulating load-current range is extended.

Figure 2:
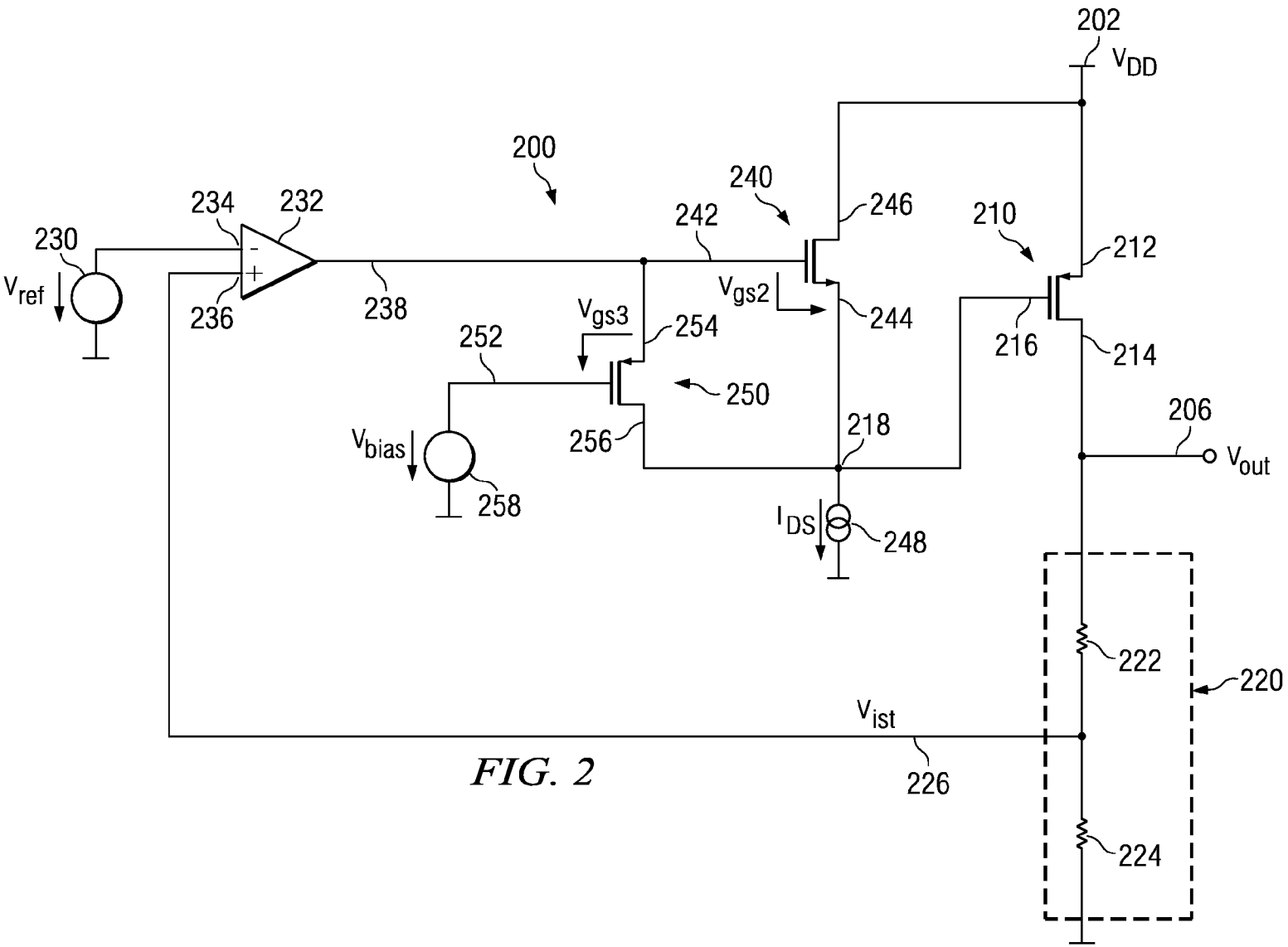
FIG. 2 shows a schematic circuit according to a second embodiment of the invention.

FIG. 2 shows a low dropout voltage regulator circuit 200 according to an alternative embodiment of the invention.

The arrangement of circuit 200 is similar to that of circuit 100 of FIG. 1, described above. Therefore, corresponding elements are given corresponding reference numerals, augmented by 100.

The primary difference from the previously described regulator circuit 100 is that the driver FET 240 and the bypass FET 250 are of an opposite conductivity type to the corresponding elements 140 and 150 in FIG. 1. In the FIG. 2 arrangement, the driver FET 240 is an NMOS FET, having its drain terminal 246 connected to the input voltage terminal 202, its source terminal 244 connected to the node 218 and its gate terminal 242 connected to the output 238 of the error amplifier 232. The drain source current $I_{DS}$ for the driver FET 240 is supplied by current source 248 connected between the node 218 and ground. The bypass FET 250 is a PMOS FET, having its source terminal 254 connected to the gate terminal 242 of the driver FET 240, its drain terminal 256 connected to the node 218 and its gate terminal 252 connected to the bias voltage source 258.

The function of the regulator circuit 200 is similar to the function of the circuit 100, described above. In the regulating load-current range, deviations of the output voltage $V_{out}$ from the desired output voltage $V_0$ are monitored by the output voltage monitor 220 and cause the error amplifier 232 to provide a control voltage $V_{err}$ to control the output FET 210 via the driver FET 240. When the actual output voltage $V_{out}$ drops, the error amplifier will raise the control voltage $V_{err}$ to drive the gate 216 of the output FET 210 towards ground via the driver NMOS FET 240.

The driver FET 240 can drive the gate of the output FET 210 to ground but not closer to the supply voltage than $V_{DD}-V_{gs2}$. The bias voltage source provides a voltage $V_{bias}$ determined such that the bypass FET 250 begins conducting when the source voltage of the driver FET 240 cannot be further raised by application of the error signal $V_{err}$ to its gate towards the drain potential, due to the inherent gate-source voltage drop $V_{gs2}$ of the driver FET 240. So, the bypass FET 250 can shunt the gate-source voltage $V_{gs2}$ of the driver FET 240, allowing the error amplifier 232 to drive node 218 and thus the gate 216 of the output PMOS FET 210 closer to the input supply voltage $V_{DD}$. Thus, the invention extends the range for the regulating load-current range.

Figure 3:
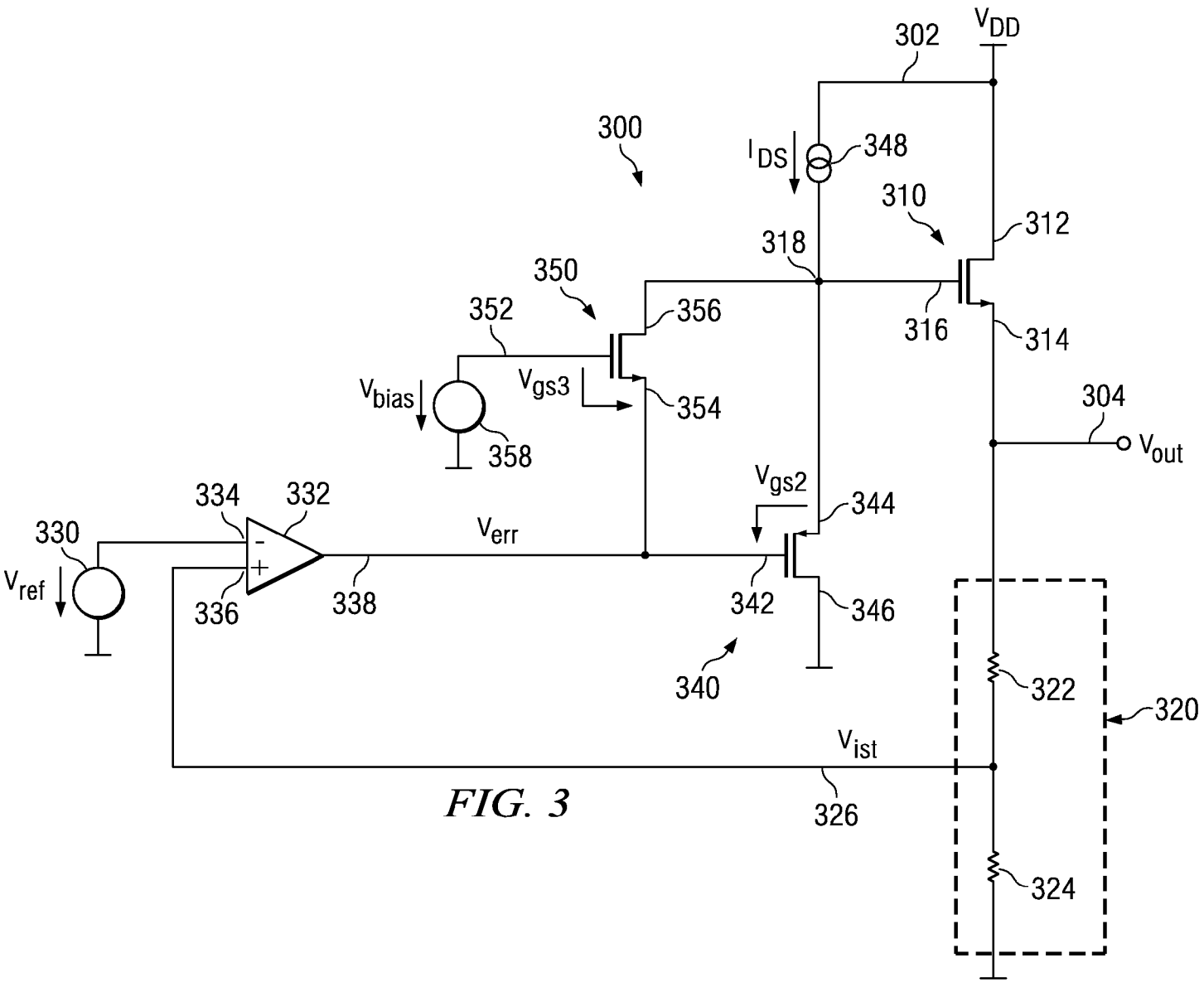
FIG. 3 shows a schematic circuit according to a third embodiment of the invention.

FIG. 3 shows a low dropout voltage regulator circuit 300 according to another alternative embodiment of the invention. The circuit 300 is also similar to the circuit in FIG. 1, described above. Therefore, like reference numerals augmented by 200 are used for components corresponding to those already described.

In this embodiment, the output FET 310 is an NMOS FET. The PMOS driver FET 340 is connected between the node 318 and ground. The current source 348, connected between the input terminal 302 and the source terminal 346 of the driver FET 340 provides a drain-source current I DS for the driver FET 340.

Deviations of the output voltage $V_{out}$ from the desired output voltage $V_0$ are monitored by the output voltage monitor 320 and cause the error amplifier 332 to provide a control voltage $V_{err}$ to control the output FET 310 via the driver FET 340. When the actual output voltage $V_{out}$ rises, the error amplifier will lower the control voltage $V_{err}$ to drive the gate 316 of the output FET 310 towards ground via the driver NMOS FET 340.

The bypass NMOS FET 350 begins conducting when the source voltage of the driver FET 340 cannot be further reduced by application of the error signal $V_{err}$ to its gate towards the drain potential, due to the inherent gate-source voltage drop $V_{gs2}$ of the driver FET 340. So, when the control voltage $V_{err}$ drops below this threshold voltage $V_{tr}$, the bypass FET 350 starts conducting current and the bypass FET 350 gradually bypasses the gate-source junction of the driver FET.

Figure 4:
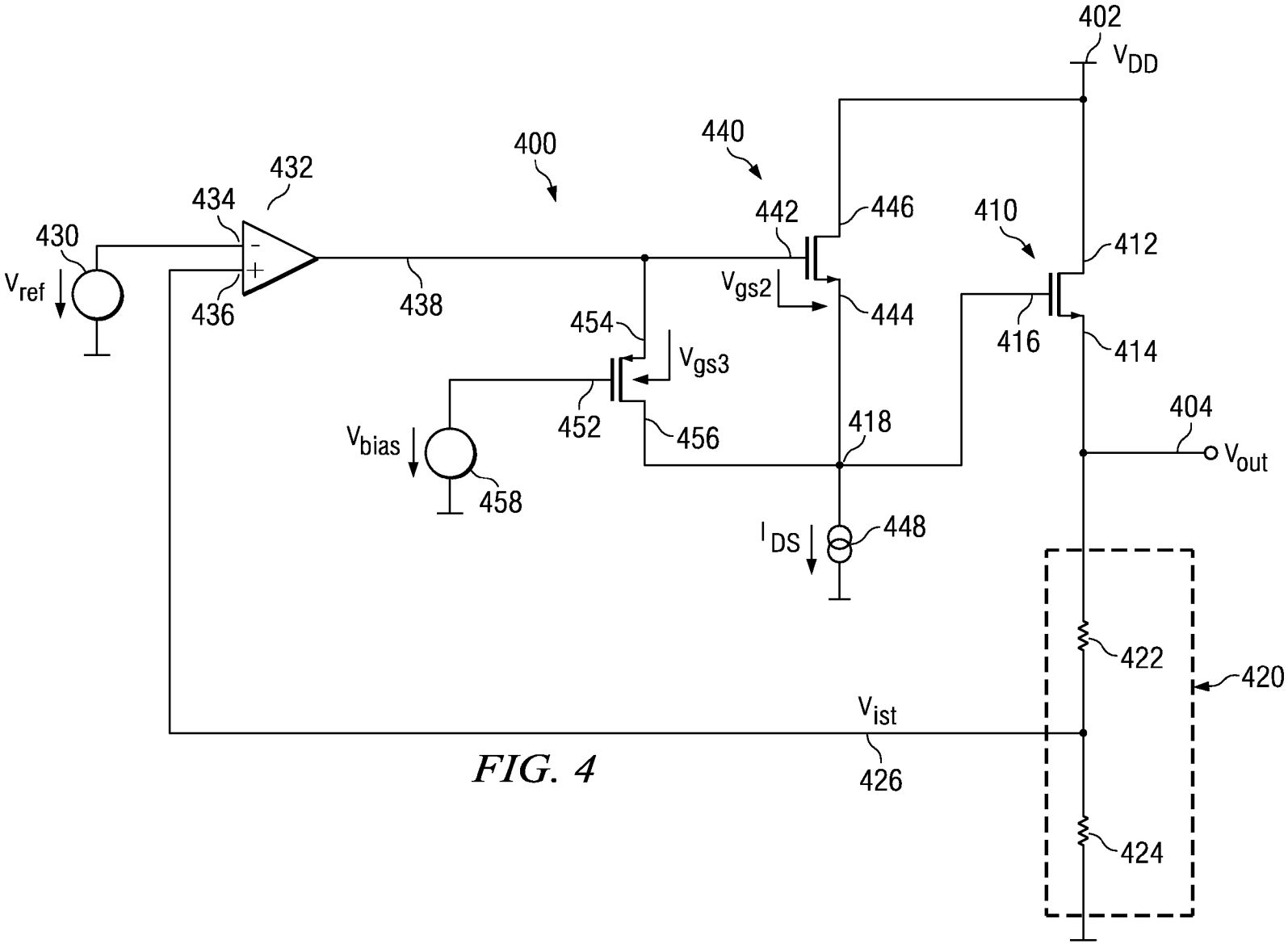
FIG. 4 shows a schematic circuit according to a fourth embodiment of the invention.

FIG. 4 shows a low dropout voltage regulator circuit 400 according to yet another alternative embodiment of the invention. The circuit 400 is similar to the circuit in FIG. 2, described above. Therefore, like reference numerals augmented by 200 are used for components corresponding to those already described.

In this embodiment, unlike the PMOS output FET 210 of FIG. 2, the output FET 410 is an NMOS FET. The NMOS driver FET 440 is connected between the supply voltage $V_{DD}$ and the node 418. The current source 448, connected between the source terminal 446 of the driver FET 440 and ground, provides a drain-source current $I_{DS}$ for the driver FET 440.

Deviations of the output voltage $V_{out}$ from the desired output voltage $V_0$ are monitored by the output voltage monitor 420 and cause the error amplifier 432 to provide a control voltage $V_{err}$ to control the output FET 410 via the driver FET 440. When the actual output voltage $V_{out}$ drops, the error amplifier will raise the control voltage $V_{err}$ to drive the gate 416 of the output FET 410 towards $V_{DD}$ via the driver NMOS FET 440.

The bypass NMOS FET 450 begins conducting in the dropout range, when the source voltage of the driver FET 440 cannot be further raised by application of the error signal $V_{err}$ to its gate towards the drain potential $V_{DD}$, due to the inherent gate-source voltage drop $V_{gs2}$ of the driver FET 440. So, when the control voltage $V_{err}$ drops below the threshold voltage $V_{gs2}$ the bypass FET 450 starts conducting current and the bypass FET 450 gradually bypasses the gate-source junction of the driver FET. In this way, the regulating load-current range is extended.

The suggested circuits provide enhanced area and power efficiency at low cost, which can be implemented in most fabrication technologies, for example, CMOS, BiCMOS as well as more modern technologies.

Those skilled in the art to which the invention relates will appreciate that the foregoing described embodiments are merely representative examples and that other embodiments can be developed within the scope of the claimed invention.

The invention claimed is:

1. A low dropout voltage regulator comprising:

a supply input terminal for connecting a supply voltage and an output terminal for providing a regulated output voltage;

a reference voltage source;

an output voltage monitor;

an error amplifier having a first input connected to the reference voltage source, a second input connected to the output voltage monitor, and an output supplying an error signal in response to deviations of the regulated output voltage from a desired target output voltage value at the output terminal;

a power output FET, having a gate terminal and a drain-source channel connected between the supply input terminal and the output terminal of the voltage regulator;

a driver FET of a p-conductivity type, having a gate terminal connected to the control output of the error amplifier, a drain terminal connected to ground and a source terminal connected to the gate of the power output FET; and a current source (148; 348) supplying a drain-source current ($I_{DS}$) for the driver FET (140; 340), connected between the supply input terminal (102; 302) and the source terminal (144; 344) of the driver FET (140; 340);

the gate terminal of the power output FET being controlled by the error amplifier via the driver FET in such a way that any deviations of the regulated output voltage from a desired target output voltage value are minimized;

the regulator further comprising:

a bypass FET of an n-conductivity type, having a source terminal connected to the gate terminal of the driver FET, a drain terminal connected to the source terminal of the driver FET, and a gate terminal connected to a bias voltage source, said bias voltage source providing a voltage determined such that the bypass FET begins conducting when the source voltage of the driver FET cannot be further reduced towards the drain potential by application of the error signal to its gate, due to the inherent gate-source voltage drop of the driver FET.

2. The voltage regulator of claim 1, wherein the power FET is a PMOS FET, having a source terminal connected to the supply input terminal, and a drain terminal connected to the output terminal of the voltage regulator.

3. A low dropout voltage regulator comprising:

a supply input terminal for connecting to a supply voltage and an output terminal for providing a regulated output voltage;

a reference voltage source;

an output voltage monitor;

an error amplifier having a first input connected to the reference voltage source, a second input connected to the output voltage monitor, and an output supplying an error signal in response to deviations of the regulated output voltage from a desired target output voltage value at the output terminal;

a power output FET having a gate terminal and a drain-source channel connected between the supply input terminal and the output terminal of the voltage regulator;

a driver FET of an n-conductivity type, having a gate terminal connected to the control output of the error amplifier, a drain terminal connected to the supply input terminal and a source terminal connected to the gate of the power output FET; and a current source supplying a drain-source current for the driver FET, connected between the source terminal of the driver FET (240; 440) and ground;

the gate terminal of the power output FET being controlled by the error amplifier via the driver FET in such a way that any deviations of the regulated output voltage from a desired target output voltage value are minimized;

the regulator further comprising:

a bypass FET of a p-conductivity type, having a source terminal connected to the gate terminal of the driver FET, a drain terminal connected to the source terminal of the driver FET, and a gate terminal connected to a bias voltage source, said bias voltage source providing a voltage determined such that the bypass FET begins conducting when the source voltage of the driver FET cannot be further raised towards the drain potential by application of the error signal to its gate, due to the inherent gate-source voltage drop of the driver FET.

4. The voltage regulator of claim 3, wherein the power FET is a PMOS FET, having a source terminal connected to the supply input terminal, and a drain terminal connected to the output terminal of the voltage regulator.

* * * * *